United States Patent [19]

Hintz

[11] 4,052,058

[45] Oct. 4, 1977

[54] PISTOL DRAW TARGET

[76] Inventor: Ronald E. Hintz, Rte. 2, Box 206, Delta, Colo. 81416

[21] Appl. No.: 674,934

[22] Filed: Apr. 8, 1976

[51] Int. Cl.[2] ..... A63B 69/00

[52] U.S. Cl. ..... 273/1 R

[58] Field of Search ..... 273/1 R, 1 E

[56] References Cited

U.S. PATENT DOCUMENTS

| | | | |
|---|---|---|---|
| 2,957,693 | 10/1960 | Ross | 273/1 E X |
| 3,065,963 | 11/1962 | Dean | 273/1 R |
| 3,082,573 | 3/1963 | Kantz | 273/1 R X |

*Primary Examiner*—Paul E. Shapiro
*Attorney, Agent, or Firm*—Marden S. Gordon

[57] ABSTRACT

An adult or child life-size two dimensional human figure designed to simulate a man withdrawing a pistol or other firearms from a holster or the like. The figure is maintained in an upright position with its legs affixed within a rigid pace and includes a weighted set of arms with the pistol drawing arm held in a down position by means of a wire rod which is tripped by pulling on a string attached thereto to spring the arm into a simulated pistol draw to provide a contest to an individual attempting to outdraw the target device.

6 Claims, 5 Drawing Figures

PISTOL DRAW TARGET

BACKGROUND OF THE INVENTION

1. Field of the Invention

This invention relates to a pistol draw target to provide a contest to an individual for purposes of training in the rapid and efficient withdrawal of a pistol from a holster or the like.

2. Description of the Prior Art

Due to the wide publicity of the West on television, in books, and the like, children and adults throughout the nation have acquired considerable interest in rapidly drawing a pistol from a holster and engage in many contests of skill to see how fast they are on the draw. Consequently, many devices in the way of toys and other game apparatus have been devised to test an individual's skill in drawing a pistol. For example, U.S. Pat. No. 3,082,573 issued to Kantz on Mar. 26, 1963 describes a toy which simulates a man withdrawing a pistol from a holster wherein the forearm is activated by a wound spring and is provided with an explosive cap to make a noise simulating the firing of a gun. Patent No. 3,008,712 issued to Konopka on November 14, 1961 relates to a pistol draw game apparatus which is an electrically operated amusement device for timing the withdrawal of a pistol from a holster by one or more individuals. U.S. Pat. No. 3,558,132 issued to Miller on Jan. 26, 1971 describes a gun drawing timing apparatus consisting primarily of an electrical timing clock for measuring the time interval required for an operator to draw a handgun, fire the same and hit the target. U.S. Pat. No. 3,680,863 issued to Wallace and Smith on Aug. 1, 1972 reveals a target shooting apparatus wherein targets are launched from a launching station toward a shooter, with a timer actuated when a target is launched and deactuated when a shooter fires at the target with a shooter being awarded a score which is adversely proportional to the time lapse between launch and firing. Although many interesting devices are available for testing ones skill at withdrawing a pistol from the holster, there is an obvious need in the marketplace for a simply constructed pistol draw target which requires a minimum of components and it is easily activated to test an individual's skill in withdrawing a pistol or other handgun.

SUMMARY OF THE INVENTION

The present invention provides a pistol draw target for testing ones skill in drawing a pistol or other handgun from a holster or the like.

It is a feature of the present invention to provide a pistol draw target.

A further feature of the present invention provides a pistol draw target which is portable and easy to use and reliable in operation.

Yet still a further feature of the present invention provides a pistol draw target which is of a rugged and durable construction and which, therefore, may be guaranteed by the manufacturer to withstand long usage.

An additional feature of the present invention provides a pistol draw target which is simple in construction and which, therefore, may be produced by a manufacturer at an economical cost.

Other features of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
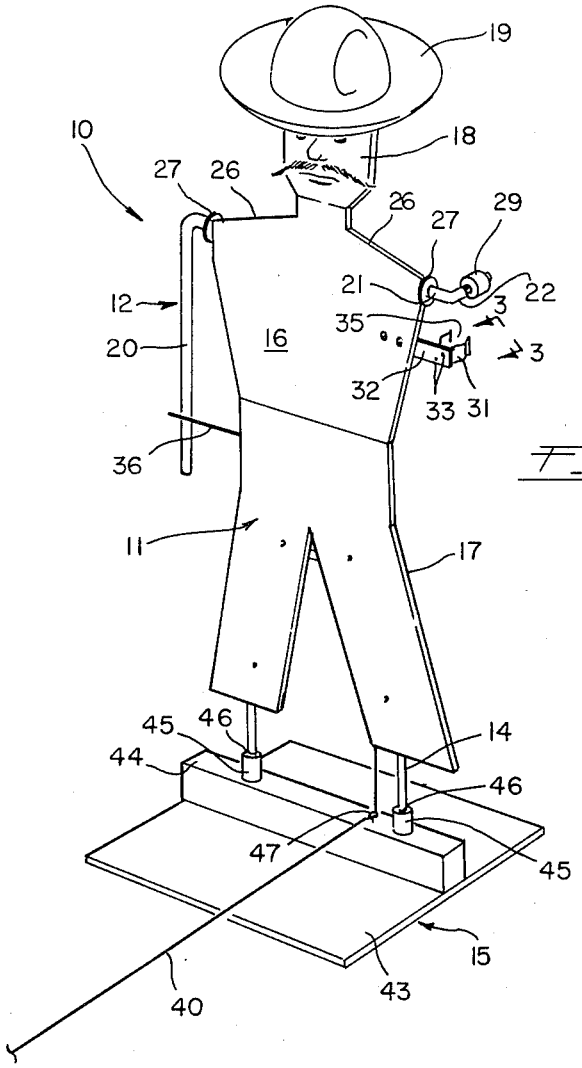
FIG. 1 is a perspective view of the pistol draw target with the simulated drawing arm in a cocked position.
Figure 3:
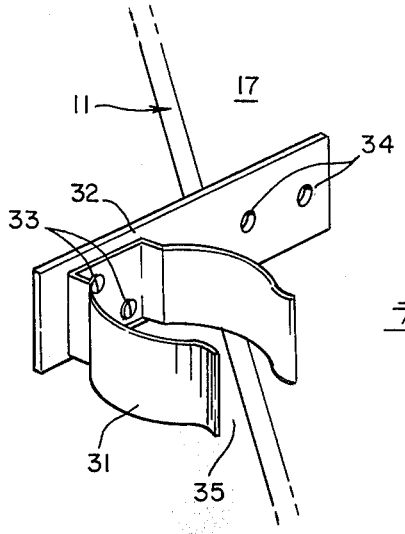
FIG. 3 is a perspective view of the U-shaped catch.

Referring now to the drawings in detail, there is illustrated a preferred form of the pistol draw target constructed in accordance with the principles of the present invention and which is designated generally in its entirety by the reference numeral 10 and which is comprised of a frame 11, an arm assembly 12, an arm trigger mechanism 13, the frame legs 14, a base 15, and associated hardware and interconnecting components as will be later described.

The frame 11 is constructed of durable material, such as plywood, pressboard, or the like, and, as shown in FIG. 1, is shaped with the configuration of a child or adult life-size figure having an opposed front surfce 16 and back surface 17 with the top portion of the front surface 16 being provided with facial features 18 and with a optional head covering or hat 19.

Figure 2:
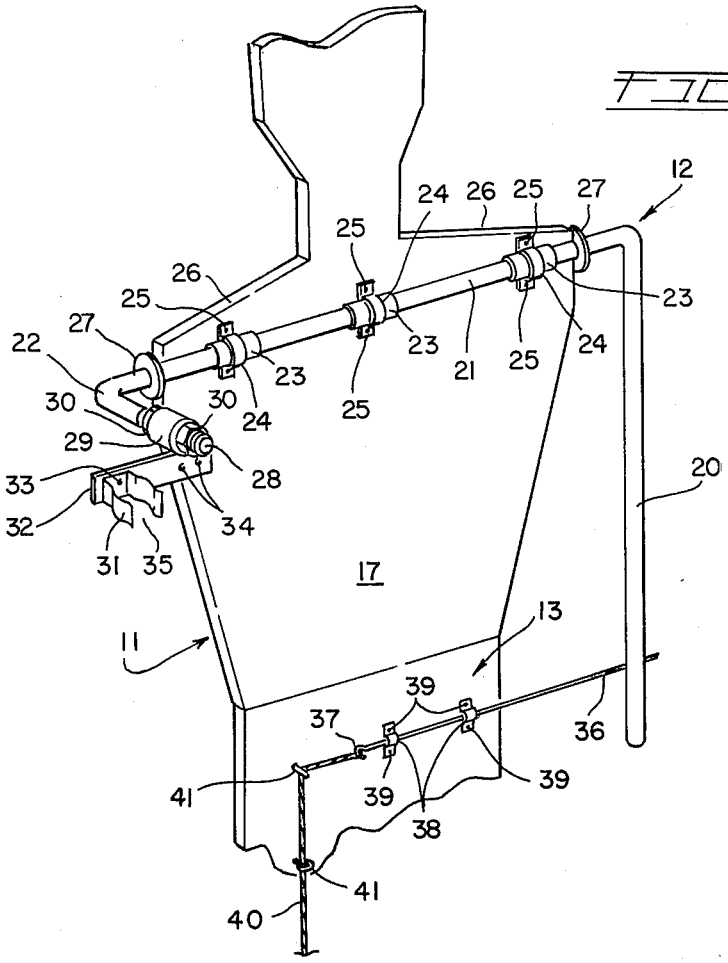
FIG. 2 is a partial rear view of the pistol draw target depicting the drawing arm components.

The arm assembly 12 consists of a length of durable rod or tubing which is bent to form a simulated arm 20, a horizontal section 21 which is bent perpendicularly to the arm 20, and the stub end 22 which is bent perpendicularly from the horizontal section 21 so as to also be perpendicular to the arm 20 and extending rearwardly from the back surface 17 of the frame 11. A series of sleeves 23 are fitted losely over and along the length of the horizontal section 21 as shown in FIG. 2 with the sleeves 23 being tightly secured to the back surface 17 by means of the U-shaped brackets 24 and the wood screw 25 so that the horizontal section 21 is positioned in the horizontal plane on the back surface 17 a short distance below the shoulder portion 26 of the frame 11. Two conventional washers 27 are positioned over the horizontal section 21 and securely affixed thereto, such as by welding, and are spaced apart by the width of the frame 11 so as to prevent side swaying of the horizontal section 21 in a horizontal direction. The stub end 22 is provided with external threads 28 a short distance from its end for assembly thereover, of a cylindrical weight 30 and which is tightened in place on the stub end 22 by means of the nuts 30. A U-shaped spring clip 31 is provided with a series of round through holes 33 for assembly to a mounting plate 32 in a conventional way, such as with bolts and nuts, rivets, and the like, which is provided with round through holes (not shown). in axial alignment with the round through holes 33, and with the mounting plate 32 being mounted to the back surface of 17 in the conventional way, such as with wood screws, through the round through holes 34 so as to line up the opening 35 of the U-shaped spring clip 31 with the weight 29 when stub end 22 in lowered into a vertical position.

The arm trigger mechanism of 13 consists of a trigger rod 36 consisting pf a length of rigid wire which is straight in configuration but formed with a loop 37 on one end thereof, with the trigger rod 36 being loosely secured within two U-shaped brackets 38 to the back surface 17 by means of conventional screws or nails 39 so that the trigger rod 36 extends in a horizontal plane a distance laterally from the frame 11 so as to extend shortly beyond the arm 20 when the trigger rod 36 is in the fully extended position. A conventional string or cord 40 is knotted on one end to the loop 37 and, as shown in FIG. 2, is dressed through two eye hooks 41, which are screwed in a conventional manner into the back surface 17 to be in vertical alignment with each other with the upper eye hook being provided in the same horizontal plane and a short distance of the loop 37 when the trigger rod 36 is in a fully outwardly extended position, and with the cord 40 being of sufficient length to extend several feet in front of the pistol draw target for use by an individual in practicing withdrawal of the pistol from the holster.

Figure 4:
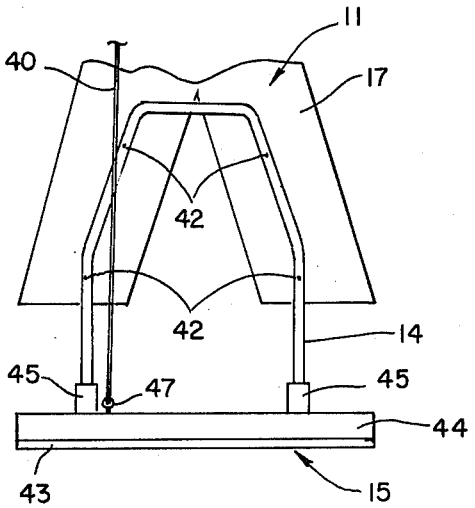
FIG. 4 is a partial rear view of the pistol draw target depicting the support legs.

The frame legs 14, as shown in FIG. 4, are constructed of a single piece of durable tubing formed in a U-shaped configuration and is provided with a series of through holes (not shown) through which the frame legs 14 are secured to the back surface 17 near the bottom thereof by means of conventional wood screws 42.

The base 15 consists of a square or rectangular base plate 43 with a reinforcement block 44 being secured to the top surface of the base plate 43 in a conventional manner, such as by nails, screws, adhesive, or the like, so as to be centrally located on the top surface of the base plate 43 in one plane and to extend the length of the base plate 43 in the opposite plane. Two cylindrical nipples 45 are securely affixed and centered on the top surface of the reinforcement block 44 with the spacing between the nipples 45 being equal to the spacing between the frame legs 14, and with the nipples 45 being provided with the round openings 46 which are slightly larger than the outside diameter of the frame legs 14 for assembly of the frame legs 14 therein to stand the frame in an upright position. The top of the reinforcement block 44 is further provided with an eye hook 47 through which the cord 40 is dressed to extend to the front of the frame 11 and which is in vertical alignment with the eye hooks 41.

Figure 5:
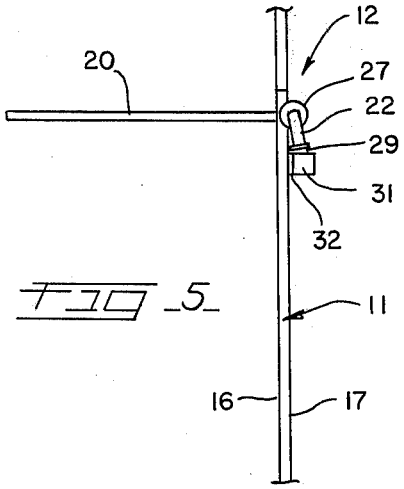
FIG. 5 is a side view of the device's arm in the drawn position.

In operation, the user stands some distance away from and facing the front surface 16 of the pistol draw target 10 with a pistol or hand gun in the holster, tucked within one's belt, or the like. The user's pistol or hand gun can be provided with blank cartridges, wax bullets, or live ammunition as desired by the user, with live ammunition being the least desirable due to possible personal hazards and quicker deterioration of the pistol draw target 10. The user or another individual pulls on the cord 40 to pull the cord through the eyelets 47 and 41 and, with the opposite end of the cord 40 attached to the loop 37 on the trigger rod 36, the trigger rod 36 is rapidly pulled through the U-shaped brackets 38 to withdraw the trigger rod 36 inwardly of the back surface 17 of the frame 11 and away from the arm 20. The weight 29 attached to the stub end 22 of the arm assembly 12 then falls from a horizontal position as shown in FIGS. 1 and 2 into a vertical position as shown in FIG. 5 where the weight 29 rapidly falls into the opening 35 to snap into the U-shaped spring clip 31, this in turn raising the arm 20 into a horizontal position, as shown in FIG. 5, to simulate the drawing of a pistol or hand gun by a pistol draw target 10. The user, of course, draws his pistol or hand gun upon the tug of the cord 40 trying to shoot at the pistol draw target 10 before the arm 20 is raised into the horizontal position, the rapidity of the user's draw being judged visually by the user or other onlookers. The arm 20 is reset into the vertical position by manually lowering the arm 20 from the horizontal position and then by manually pulling the trigger rod 36 laterally from the back surface 17 of the frame 11 to hold the arm 20 in place as previously described. The pistol draw target 10 is portable and can readily be moved from one place to another by lifting the frame legs 14 out of the nipples 45 provided on the base 15 for setting up the pistol draw target 10 in another location.

There is thus provided a novel pistol draw target for use in testing or practicing one's skill in withdrawing a pistol or hand gun from a holster or the like, the invention being simple in construction and requiring a minimum number of moving parts to meet its stated objectives.

It is to be understood that the form of this invention as shown and described is to be taken as a preferred example thereof, and that this invention is not to be limited to the exact arrangement of parts described in the description or illustrated in the drawings as changes thereto in the details thereof pertaining to size, shape and arrangement of parts thereof are envisioned within the scope of the invention without departing from the novel concepts of the invention.

Having thus described the invention, what is claimed is:

1. A pistol draw target device intended for use by an individual to test and practice their skill in withdrawing a pistol from a holster, the pistol draw target device comprising, in combination:

a flat frame member in a shape defining a head portion, torso portion, and leg portion of an individual, the frame member having a flat front surface and a flat back surface;

a U-sahped leg defining member secured to the back surface of the frame member rearwardly of the leg portion thereof with its bight portion disposed nearest the torso and with its leg portions extending parallel to the frame member and outwardly of the frame member leg portions, each leg portion terminating an equidistance from the frame member;

a base member of a substantially rectangular flat configuration having a flat bottom surface adapted to rest firmly and securely on the ground, a top surface, and opposed end and side surfaces;

a pair of socket defining elements each affixed to the top surface of the base member a spaced distance apart from each other with their axis extending parallel to each other and normal to the plane of the base member, the spacing between the sockets being substantially equal to the spacing between the terminal ends of the U-shaped leg defining member wth the sockets adapted to receive therein said ends to support said frame member on said base member in an upright vertically disposed position;

a unitary rod member bent along its axis to define three portions thereof, namely, an arm member, a main body member, and a stub end member, the arm member disposed at a ninety degree angle to the body member and projecting outwardly in a radial direction therefrom, the stub end member disposed at a ninety degree angle to the body member and to the arm member and projecting outwardly from the body member in a direction normal to the plane defined by the combined arm and body members;

a plurality of bracket means rotatably securing the body member to the back surface of the frame member a short distance below a shoulder defining portion of the torso portion and extending in a horizontal direction and projecting outwardly from both sides of the frame member in the general area of the shoulders thereof;

said bracket means permitting rotatable movement of the body member about its longitudinal axis along with longitudinal movement therealong;

means affixed to opposite end portions of the body member inwardly of the stub end member and arm member thereof to limit the longitudinal sliding movement of the body member relative to the frame member by bearing against opposite side edges of the frame member;

said rod member when affixed to said frame member having the arm member extending vertically downwardly in an arm like manner with the stub end member extending outwardly rearwardly of the frame member back surface;

weight means secured to the stub end member to bias the stub end to seek a vertical position;

a stop member affixed to the frame member a distance vertically below the stub end member junction with the body member, the stop member having a U-shaped spring clip extending rearwardly outwardly therefrom of a size and configuration to engage and retain therein the stub end member when in the vertical position;

a rigid trigger arm having a leading end and a trailering end, the trailering end being bent into the shape of a loop;

bracket means securing the trigger arm in a horizontal position on the frame member back surface at a position disposed vertically below the waist of the torso portion, the trigger arm being slidable along its axis between an operative position where the leading end extends outwardly of the frame member a distance to engage the arm member when in the vertical position, and an in operative released position where it is free of the arm member and out of the path of movement of the arm member; and a flexible cord having one end affixed to the loop of the trigger arm trailering end with its opposite end extending a distance outwardly and away from the frame member to the position of the individual using the pistol draw device;

whereby the device is armed by placing the arm member in the vertical downward position and retaining it there by engaging the trigger arm therewith, and upon the individual pulling the cord to release the trigger arm from engagement with the arm member the weighted stub end member rotates about the axis of the horizontal body member in a downward direction driving the arm member upwardly and forwardly of the frame member in a pistol drawing gesture.

2. The pistol draw target device as set forth in claim 1 wherein the weight means on the stub end member comprises an open ended cylindrical weight having a passageway extending completely axially therethrough, screw threads formed on the outer end portion of the stub end, and a pair of nuts threaded on the stub end with the weight captured therebetween and thus secured thereby to the stub end.

3. The pistol draw target device as set forth in claim 2 further characterized by a plurality of guide means affixed to the back surface of the frame member and to the top surface of the base member for training the flexible cord therethough in its path from the trigger arm to the individual.

4. The pistol draw target device as set forth in claim 3 further characterized by a hat removeably seated on the head portion of the frame member.

5. The pistol draw target device as set forth in claim 4 further characterized by facial features being defined on the front surface of the head portion of the frame member.

6. The pistol draw target device as set forth in claim 5 wherein the frame member is manufactured of wood.

* * * * *